US006155578A

United States Patent [19]

Patterson

[11] Patent Number: 6,155,578

[45] Date of Patent: Dec. 5, 2000

[54] BINDING MOUNT

[76] Inventor: Patrick J. Patterson, 9901 Nevada Ave., Chatsworth, Calif. 91311

[21] Appl. No.: 09/294,245

[22] Filed: Apr. 19, 1999

Related U.S. Application Data

[60] Provisional application No. 60/082,584, Apr. 21, 1998.

[51] Int. Cl.[7] ..... A63C 9/08

[52] U.S. Cl. ..... 280/14.24; 280/607; 280/618

[58] Field of Search ..... 280/14.21, 14.24, 280/617, 618, 607, 633, 634

[56] References Cited

U.S. PATENT DOCUMENTS 5,044,654 9/1991 Meyer .
5,354,088 10/1994 Vetter et al. .
5,553,883 9/1996 Erb .
5,577,755 11/1996 Metzger et al. .
5,584,492 12/1996 Fardie .
5,667,237 9/1997 Lauer .

FOREIGN PATENT DOCUMENTS

4209112A1 10/1992 Germany .

*Primary Examiner*—Richard M. Camby
*Attorney, Agent, or Firm*—David Weiss

[57] ABSTRACT

A mount for securing a boot binding to a snowboard for permitting the binding to be easily rotated between a user-preferred snowboarding orientation preset by the binding, to an orientation approximately parallel to the snowboard's longitudinal axis, and to conveniently and accurately return the binding to its original preset snowboarding orientation.

20 Claims, 7 Drawing Sheets

Fig. 5.
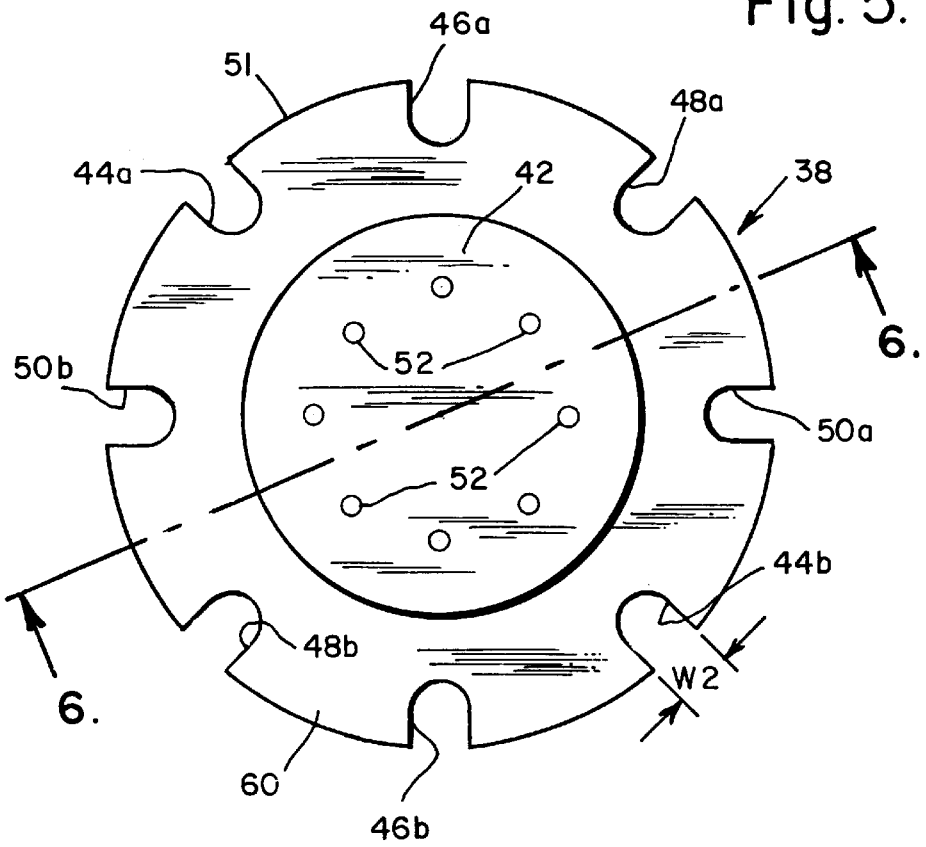
Fig. 6.
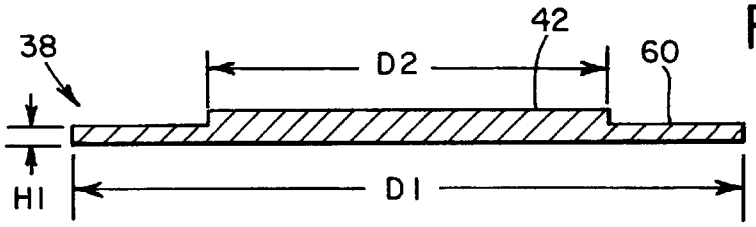
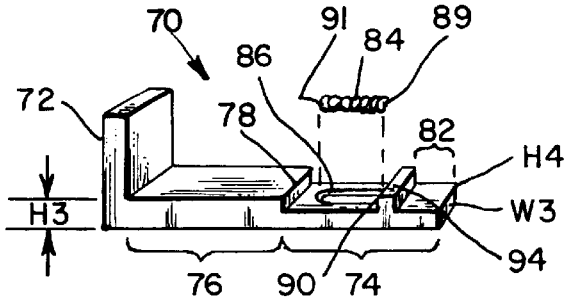
Fig. 10.

Fig. 13.
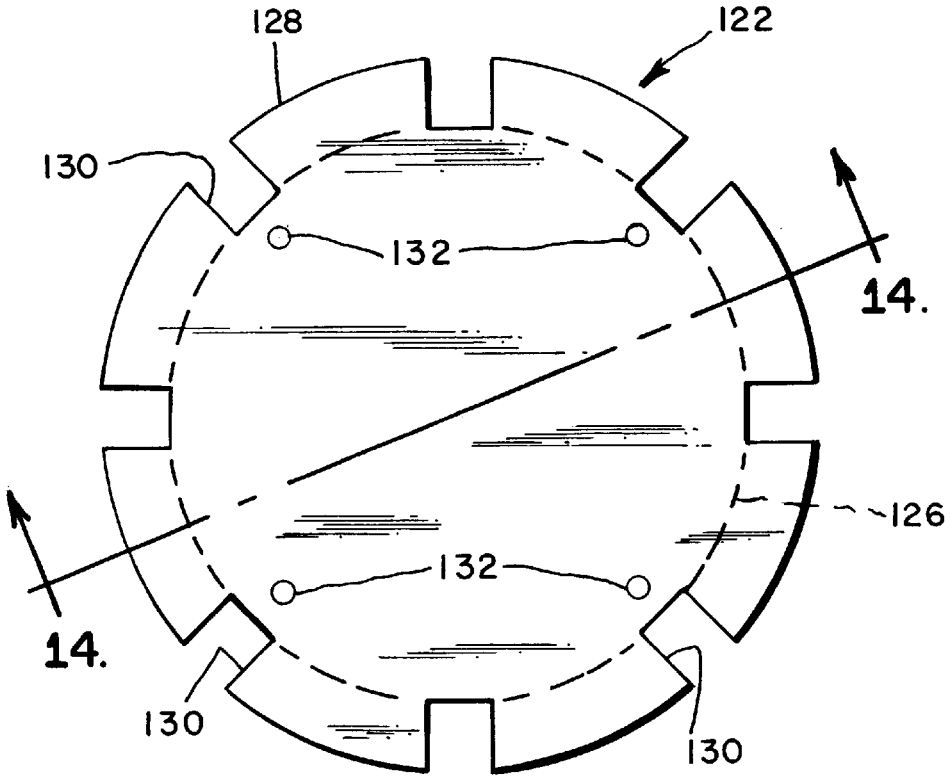
Fig. 14.
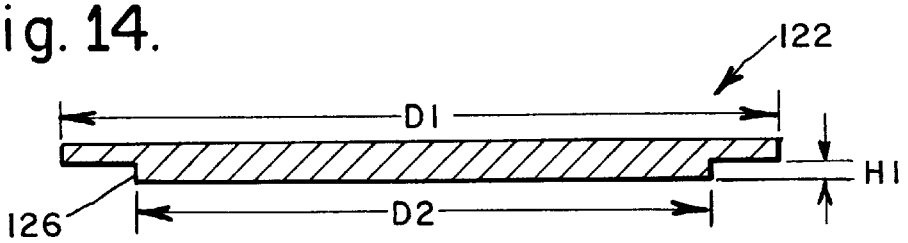
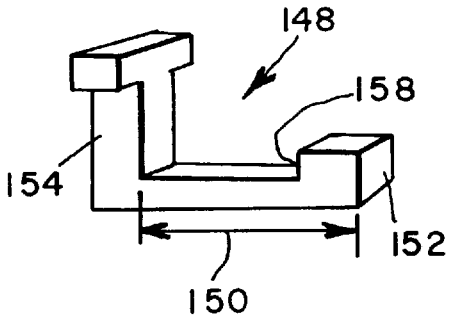
Fig. 18.

Fig. 15.
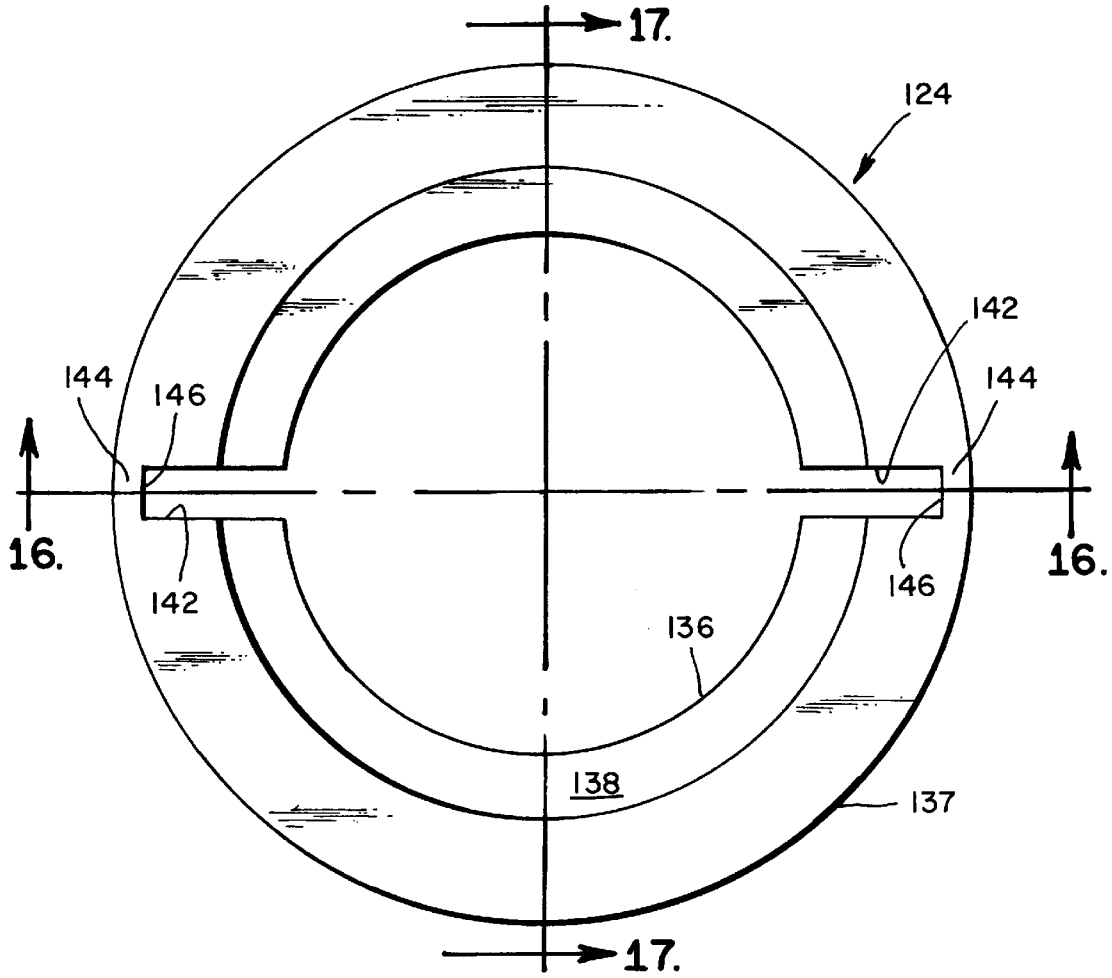
Fig. 16.
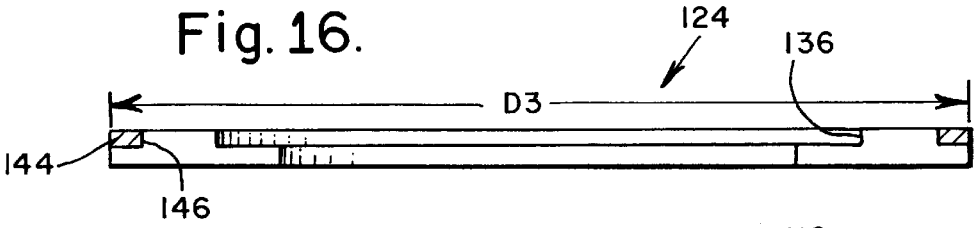
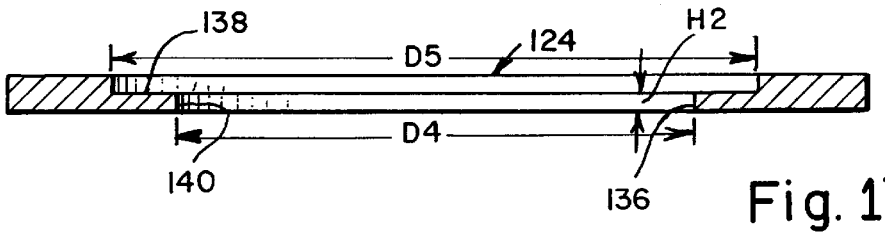
Fig. 17.

BINDING MOUNT

CROSS REFERENCE TO RELATED APPLICATION

This application claims the benefit of U.S. Provisional Application No. 60/082,584, filed Apr. 21, 1998, which application is incorporated herein by reference.

FIELD OF THE INVENTION

This invention relates to binding mount devices for sports boards, and more particularly to a device that is securable to a snowboard for pivotally mounting a boot binding to the snowboard.

BACKGROUND OF THE INVENTION

The snowboard used in practicing the well known and popular sport of snowboarding is typically an elongated generally flat board. A pair of boot bindings, to which the snowboard user's worn boots are to be held, are normally secured directly to the snowboard at two spaced locations along the snowboard's longitudinal axis. The bindings are normally positioned or oriented so that, when the user's boots are held by the bindings, his or her feet are spaced from one another and are angularly oriented with respect to the board's longitudinal axis, usually between 90° and 45° (corresponding to 0° to 45° from perpendicular to the snowboard's longitudinal axis) depending upon the personal preference of the user, although angular orientations from perpendicular may sometimes be as great as 60°.

When the user is not actively snowboarding but desires to walk or stand, for example prior to and after engaging in a snowboarding run, or while approaching and waiting in a ski lift line, the user typically removes his or her boot from one of the bindings (generally from the rear binding) while his other boot remains secured to the other binding (generally the forward binding). The tendency is to walk with his free foot while dragging the snowboard with his secured foot, in the direction of the snowboard's longitudinal axis. However, walking in this manner is hindered since the user's secured foot is generally close to perpendicular of the snowboard's longitudinal axis, and the user incurs lateral stress on his secured ankle as well as his knee and hip.

Boot bindings for snowboards, whether of the plate type or of the high back type, are conventionally directly secured to the snowboard and oriented in a user-preferred snowboarding position or orientation with respect to the snowboard's longitudinal axis. With respect to such securement, some bindings may be rotated and locked at different angular positions only by using external tools and with the boot removed from the binding, while others may be rotated and locked with the boot secured to the binding and without using external tools. Both such bindings are concerned with providing a personally suitable or preferred stance angle while snowboarding, while the latter type of binding may also be used for rotating the secured boot for alignment generally parallel to the snowboard's longitudinal axis for ease of walking. With this latter type, however, prior to resumption of a snowboarding operation, the user rotates the binding back to a snowboarding orientation normally without assurance that the originally desired snowboarding position or orientation has in fact been effected.

SUMMARY OF THE INVENTION

The present invention provides a mount for securing a boot binding to a snowboard for permitting the binding to be easily rotated (without tools and without removing the boot therefrom) between a user-preferred snowboarding orientation preset by the binding, to an orientation approximately or more closely parallel to the snowboard's longitudinal axis or direction, and to easily and accurately return the binding to its original preset snowboarding position or orientation. The mount of the present invention may be used with virtually any commercially available binding of which the inventor is presently aware, permitting the binding itself to be preset (according to the binding manufacturer's directions) to the user's preferred snowboarding orientation, and—without disrupting the binding's orientation with respect to the mount of the present invention—with the binding secured thereto to be rotated and locked such that the binding with the user's boot secured thereto is approximately or more closely parallel to the snowboard's longitudinal axis or direction. Upon unlocking the mount, reverse rotation of the mount causes the mount to automatically stop and be locked such that the binding with the user's boot secured thereto is at its original preset orientation with respect to the longitudinal axis of the snowboard.

Briefly described, the mount of the present invention comprises: a first member adapted to be fixedly secured to a binding for a snowboard; a second member adapted to be fixedly secured to the snowboard, the second member capturing the first member with the first member rotationally displaceable with respect to the second member when the second member is secured to the snowboard; a first radial notch along the periphery of one of the members, and a second radial notch along the periphery of such one of the members; a radially inwardly biased detent carried by such other of the members for engaging either of the first and second notches to prevent rotation of the first member, the detent being outwardly urgeable for disengaging from the first and second notches to permit rotation of the first member; the detent engaging the first notch when the first member is secured to the binding oriented in a preset snowboarding position; and the second notch being spaced from the first notch such that the binding orientation is approximately parallel to the snowboard longitudinal axis when the first member is rotationally displaced with the detent engaging the second notch. The first member may include a plurality of second radial notches peripherally spaced from the first notch such that the binding orientation is approximately parallel to the snowboard longitudinal axis when the first member is rotationally displaced with the detent engaging a selected on of the second notches. In one embodiment, the first member is a disk with the first and second notches along the circumference of the disk, the disk including a circular boss concentric with the circumference; the second member is an annular plate having a central bore receiving the boss and further having an annular recess extending from the bore and receiving the remainder of the disk; and the detent is carried by the annular plate. In another embodiment, the second member is a disk with the first and second notches along the circumference of the disk, the disk including a circular boss concentric with the circumference; the first member is an annular plate having a central bore receiving the boss and further having an annular recess extending from the bore and receiving the remainder of the disk; and the detent is carried by the annular plate.

In a preferred embodiment, the mount of the present invention comprises the combination of: a first member adapted to be fixedly secured to a binding for a snowboard; a second member adapted to be fixedly secured to the snowboard, the second member capturing the first member with the first member rotationally displaceable with respect to the second member when the second member is secured to the snowboard; a first pair of opposing radial notches along the periphery of one of the members, and a second pair of opposing radial notches along the periphery of such one of the members; a pair of opposing radially inwardly biased detents carried by the other of the members for engaging either of the first and second pairs of notches to prevent rotation of the first member, the detents being outwardly urgeable for disengaging from the first and second pairs of notches to permit rotation of the first member; the detents respectively engaging the first pair of notches when the first member is secured to the binding oriented in a preset snowboarding position; and the second pair of notches being spaced from the first pair of notches such that the binding orientation is approximately parallel to the snowboard longitudinal axis when the first member is rotationally displaced with the pair of detents engaging the second pair of notches. Preferably, the first member includes a plurality of second pairs of opposing radial notches peripherally spaced from the first pair of notches such that the binding orientation is approximately parallel to the snowboard longitudinal axis when the first member is rotationally displaced with the pair of detents engaging a selected one of the second pairs of notches. In the preferred embodiment of the mount of the present invention, the first member is a disk with the first and second pairs of notches along the circumference of the disk, the disk including a circular boss concentric with the disk circumference; the second member is an annular plate having a central bore receiving the boss and further having an annular recess extending from the bore and receiving the remainder of the disk; and the detents are carried by the annular plate. In another embodiment of the mount, the second member is a disk with the first and second pairs of notches along the circumference of the disk, the disk including a circular boss concentric with the disk circumference; the first member is an annular plate having a central bore receiving the boss and further having an annular recess extending from the bore and receiving the remainder of the disk; and the detents are carried by the annular plate.

BRIEF DESCRIPTION OF THE DRAWINGS

The novel features which are believed to be characteristic of the invention, together with further advantages thereof, will be better understood from the following description considered in connection with the accompanying drawings in which preferred embodiments are illustrated by way of examples. It is to be expressly understood, however, that the drawings are for the purpose of illustration and description only, and are not intended as a definition of the limits of the invention.

FIG. 5 is a top plan view of a first or rotatable component of the preferred embodiment of FIG. 3;

FIG. 6 is a sectional view of the component of FIG. 5, taken along the line 6—6 in the direction of the appended arrows;

FIG. 10 is a perspective view of a locking detent component of the preferred embodiment of FIG. 3;

FIG. 13 is a top plan view of a first or rotatable component of the alternative embodiment of FIG. 11;

FIG. 14 is a sectional elevation view of the component of FIG. 13, taken along the line 14—14 in the direction of the appended arrows;

FIG. 15 is a top plan view of a second or stationary component of the alternative embodiment of FIG. 11;

FIG. 16 is a sectional elevation view of the second component of FIG. 15, taken along the line 16—16 in the direction of the appended arrows;

FIG. 17 is a sectional elevation view of the second component of FIG. 15, taken along the line 17—17 in the direction of the appended arrows; and FIG. 18 is a perspective view of a locking detent component of the alternative embodiment of FIG. 11.

DESCRIPTION OF THE PREFERRED EMBODIMENTS

Figure 1:
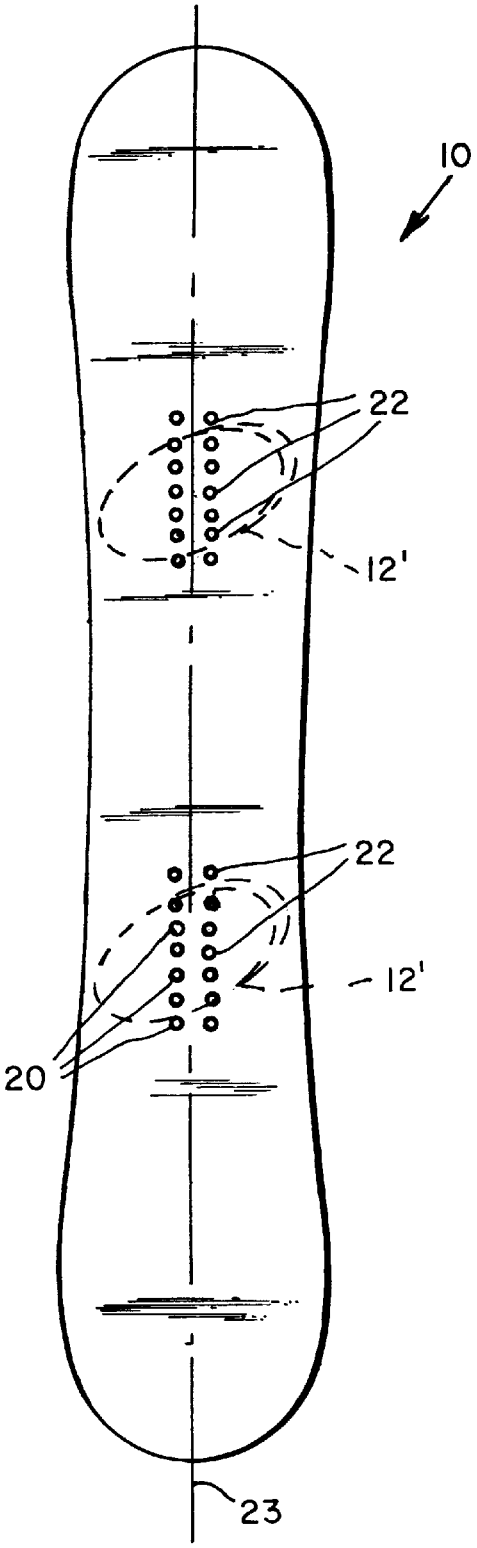
Fig. 1. (PRIOR ART)
FIG. 1 is a top plan view of a conventional snowboard.
Figure 2:
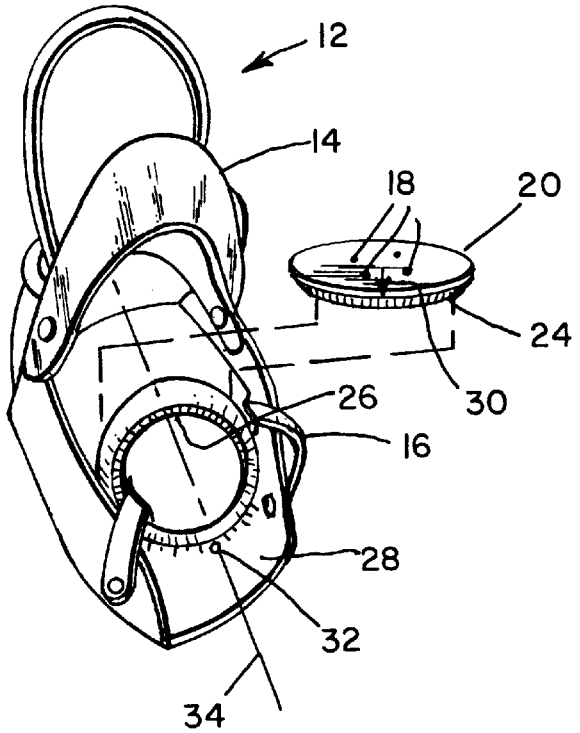
Fig. 2. (PRIOR ART)
FIG. 2 is a perspective view of a conventional binding for holding a snowboarder's boot and which is securable to the snowboard of FIG. 1.

Turning to FIGS. 1 and 2, a conventional snowboard 10 is typically an elongated generally flat board. A boot binding 12, which is one of a pair of bindings 12 to which the boots worn by the snowboard user are to be held by straps 14, 16 (the front strap 16 being shown cutaway for clarity), is normally fixedly secured to the snowboard 10, such as by screws inserted through bores 18 in a binding hold-down plate 20 and threadably engaging selected ones of tapped blind bores 22 in the snowboard 10, the pair of bindings 12 being secured at two spaced locations along the longitudinal dimension or axis 23 of the snowboard 10.

In the type of binding 12 shown in FIG. 2, the hold-down plate 20 has a frusto-conical edge 24 with gear teeth therealong for mating with teeth about a frusto-conical bore 26 in the binding's bottom plate 28. The mating teeth along the hold-down plate edge 24 and the bottom plate 28 are typically set 3° apart, so that the hold-down plate 20 and the bottom plate 28 may be rotationally positioned at 3° intervals when the hold-down plate 20 is inserted in the frusto-conical bore 26 of the bottom plate 28. An example of this type of boot binding for a snowboard is marketed by Burton Snowboards, of Burlington, Vt.

Before securing the binding 12 to the snowboard 10 in conventional manner, the toothed edge 24 of the binding's hold-down plate 20 is inserted onto the mating toothed surface of the frusto-conical bore 26 of the binding's bottom plate 28 such that a reference marker or arrow 30 on the hold-down plate 20 is rotationally displaced from a center or 0° marker 32 inscribed on the bottom plate 28 along the circumference of the bore 26, the 0° marker 32 being positioned along the longitudinal axis of the boot binding 12. The amount of such rotational displacement of the arrow 30 from the 0° marker 32 represents a preferred stance angle when the binding 12 is secured to the snowboard 10 with the arrow 30 oriented perpendicular to the snowboard's longitudinal axis 23. When the binding 12 is secured to the snowboard 10 by means of screws inserted in hold-down plate bores 18 and threadably engaging the corresponding bores 22 of the snowboard 10 with the arrow 30 pointed perpendicular to the snowboard longitudinal axis 23, the hold-down plate 20 secures the binding bottom plate 28 to the snowboard 10 such that the binding 12 is oriented at the preset stance angle or angular displacement from the perpendicular to the snowboard's longitudinal axis 23. For example, the dashed outlines 12' in FIG. 1 represent typical orientations of the bindings (and hence the operator's boots), so that when the snowboard 10 is in use with the operator's left foot forwardly (i.e. the lower binding 12' as viewed in the drawing of FIG. 1) of his right foot, the user would be facing to the left as viewed in the drawing of FIG. 1.

The present invention provides a mounting device that is situated between one of the bindings 12 and the snowboard 10, specifically the binding to which the user's boot remains secured when the other boot is removed from the other binding for permitting the user to walk between snowboarding runs. Instead of securing that binding (which is normally the forward one of the two bindings 12) directly to the snowboard 10 as is done in the prior art, the mount of the present invention is secured to the snowboard 10 and to that boot binding 12. The binding 12 is secured in a preset snowboarding orientation preferred by the user, and the mount permits the boot binding to be locked in the preferred snowboarding orientation. The mount is rotatable to at least one other lockable position for orienting the secured binding 12 approximately or more closely parallel to the snowboard's longitudinal axis 23 between snowboarding runs, and is further rotatable to the original locked position for accurately orienting the secured binding 12 to its initial preset orientation for snowboarding runs.

Figure 3:
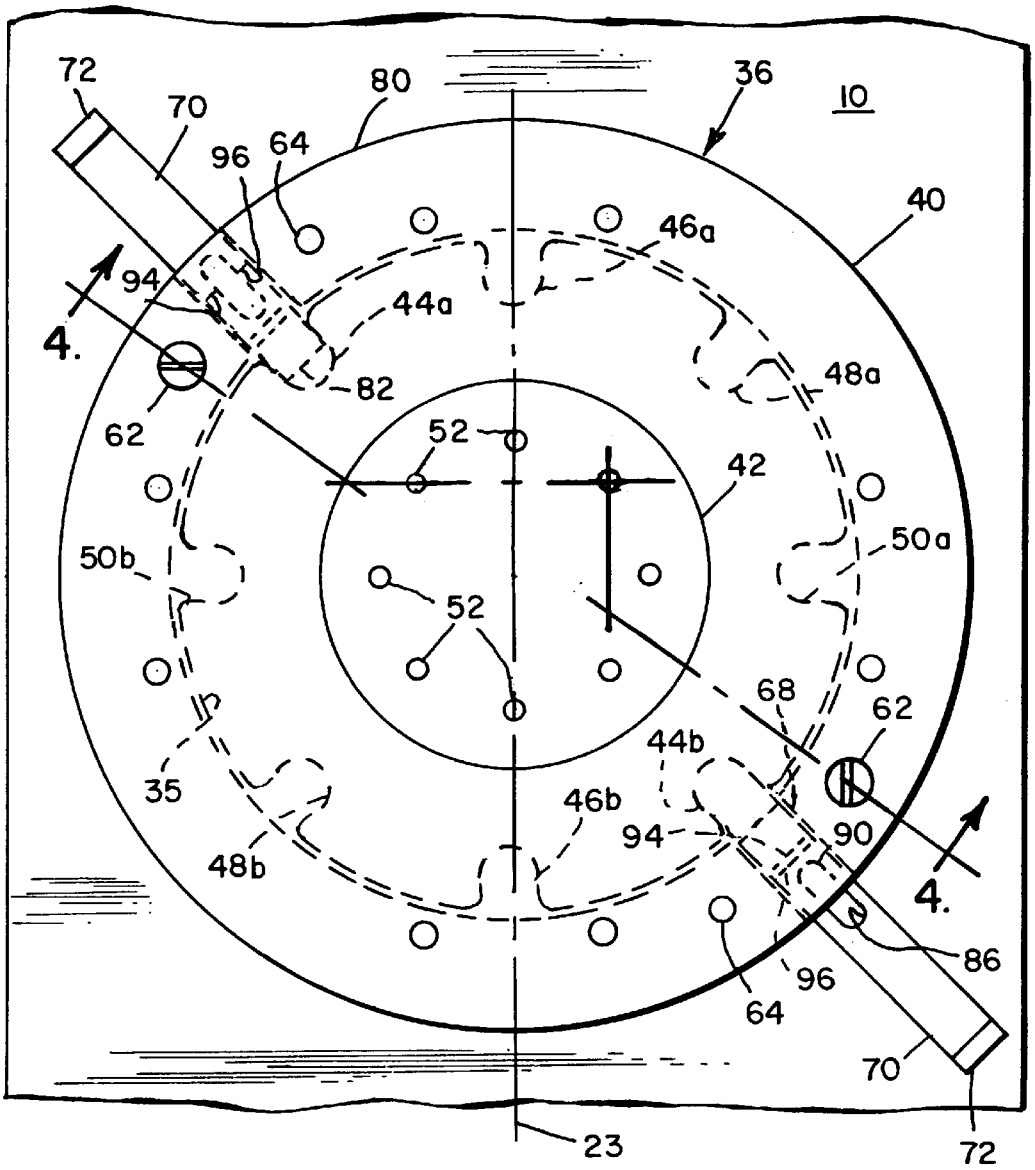
FIG. 3 is a plan view of a preferred embodiment of the binding mount of the present invention, shown secured to a fragment of a snowboard.
Figure 4:
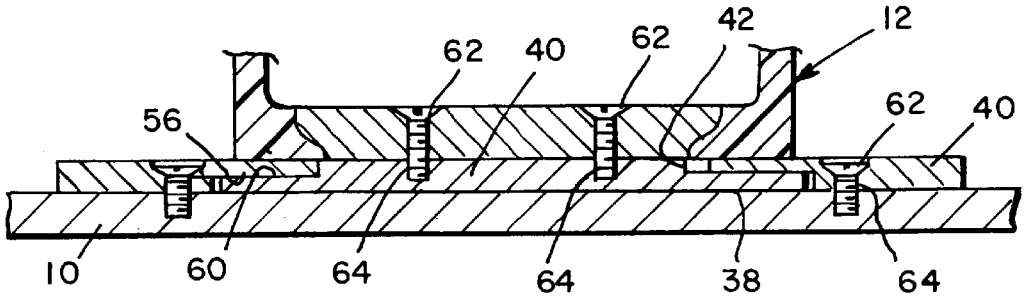
FIG. 4 is a sectional view of the apparatus of FIG. 3, taken along the line 4—4 in the direction of the appended arrows, shown secured to a fragment of a boot binding.

A preferred embodiment 36 of the binding mount device of the present invention is shown in FIGS. 3 through 10. The mount 36 includes a first component or member 38 to which a boot binding 12 is to be secured, cooperating with a second component or member 40 to be fixedly secured to the snowboard 10, the first member 38 actuable for being rotated or pivoted with respect to the second member 40. As shown in FIGS. 3–6, the first member 38 comprises a circular plate or disk 38 of diameter D1 having an upwardly extending concentric boss 42 of diameter D2. Radial notches 44, 46, 48, 50 of width W1 are spaced along the periphery or circumference 51 of the disk 38, preferably equally spaced along the circumference 51. In the preferred embodiment, a first pair of radial notches 44*a*, 44*b* oppose one another or are 180° apart, i.e. the notches 44*a*, 44*b* are situated along a diameter of the disk 38. Specifically, the preferred embodiment of the disk 38 includes a first pair of opposing notches 44*a*, 44*b* and at least one second pair and preferably a plurality of second pairs of opposing radial notches, indicated in FIG. 5 by reference numerals 46*a* and 46*b*, 48*a* and 48*b*, and 50*a* and 50*b*, and each pair of the second pair of notches 46, 48, 50 are spaced from the first pair of notches 44 as described below. The disk 38 includes tapped bores 52 which are preferably arranged in a pattern for being aligned with the bores 18 of the boot binding 12, for fixedly securing the boot binding 12 to the disk 38 by screws 54 (FIG. 4).

The second component or member 40, in the preferred mount embodiment 38, comprises a flat ring or annular plate 40 (see in particular FIGS. 7–9) of outside diameter D3 and having a central bore 54 of diameter D4, with an annular stepped recess 56 of diameter D5 extending from the annular plate's inner circumference or central bore 54. The recess 56 outside diameter D5 is slightly greater than the outside diameter D1 of the disk 38, and the inside diameter D4 of the annular plate 40 is slightly greater than the disk boss 42 diameter D2. The overall thickness (or height) of the disk 38 and the overall thickness (or height) of the annular plate 40 are preferably substantially the same, and the height H1 of the disk portion 60 extending between the disk circumference 51 and the boss 42 is preferably slightly less than the height H2 of the annular lip 58 along the recess circumference of outside diameter D5 of the annular plate 40. Accordingly, the annular plate 40 shown in FIG. 7 may be inverted and placed over the disk 38, with the disk boss 42 within the annular plate central bore 54 and the upper surface of the disk portion 60 outwardly of the boss 42 contacting the annular plate recess 56. When the disk 38 and the annular plate 40 are so combined, and the annular plate 40 is fixedly secured to the snowboard 10, the disk portion 60 outwardly of the boss 42 is vertically and horizontally captured by the annular plate recess 56, and the disk 38 is rotatable with respect to the stationary annular plate 40. The annular plate 40 may be fixedly secured to the snowboard 10 by means of screws 62, in selected bores 64 extending through the annular plate outer portion 66 between the recess outside circumference of diameter D5 and the annular plate outside circumference of diameter D3, threadedly secured to the snowboard 10 as shown in FIG. 4.

Figure 7:
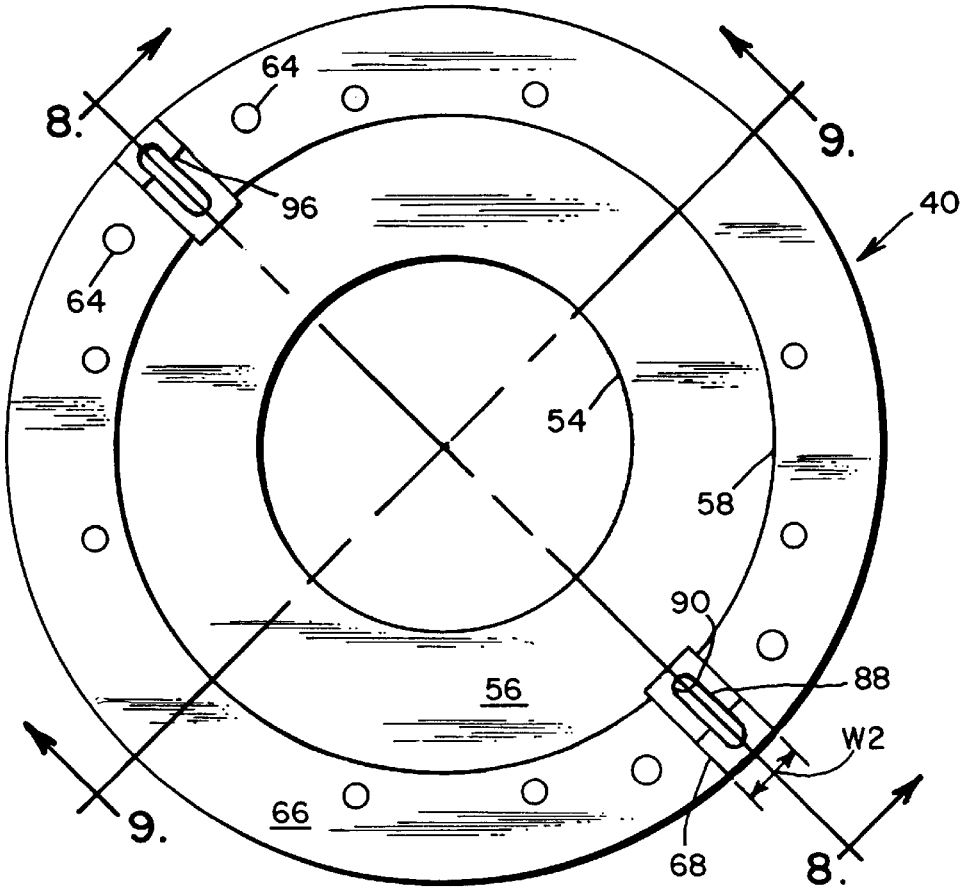
FIG. 7 is a bottom plan view of a second or stationary component of the preferred embodiment of FIG. 3.
Figure 8:
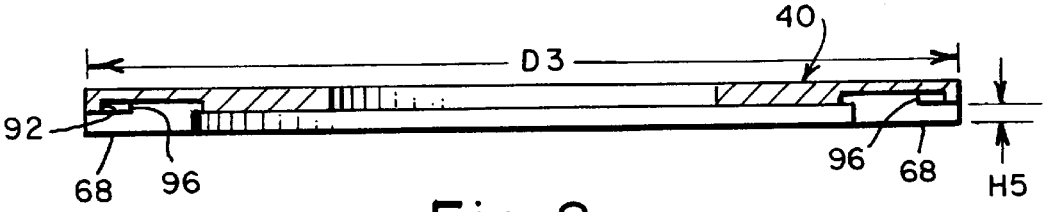
FIG. 8 is a sectional elevation view of the second component of FIG. 7, taken along the line 8—8 (as if FIG. 7 were a top plan view) in the direction of the appended arrows.
Figure 9:
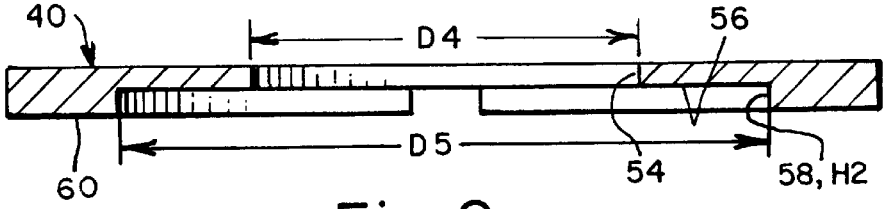
FIG. 9 is a sectional elevation view of the second component of FIG. 7, taken along the line 9—9 (as if FIG. 7 were a top plan view) in the direction of the appended arrows.

As shown in FIGS. 3, 7 and 8, the annular plate 40 includes a pair of opposed channels 68 extending from the annular plate's outside circumference and through the annular plate's outer portion 66. The channels 68 receive respective spring-loaded locking pins or detents 70 as explained below.

An example of the detents 70 is shown in FIG. 10, for use with the preferred mount embodiment of FIG. 3, and is a generally elongate member with an upwardly extending handle 72 at its outer end. The detent member 70 includes an inner elongate portion 74 of rectangular cross-section, the width W3 of which is slightly less than the width W2 of the channel 68. The height H3 of the portion 76 of the detent 70 between the inner portion 74 and the handle (also of rectangular cross-section of width W3) is substantially equal to the overall height (or thickness) of the annular plate 40, and the inner portion 74 is stepped downwardly from the outer portion 76 resulting in a lip 78. The height H4 of the detent inner portion 74 (except for the upstanding stop 94) is slightly less than the minimum height H5 of the annular plate channel 68 and of the height H2 of the annular plate's annular lip 58. The width and height relationships permit the detent 70 to slide within a channel 68 of the annular plate 40, along a diameter thereof, and into any one of the notches 44, 46, 48, 50, when such notch is aligned with the channel 68 and the disk 38 and annular plate 40 are combined with the annular plate 40 secured to the snowboard 10 as shown in FIG. 3. The detent 70 is inwardly slideable until a forward portion 82 of the detent inner portion 74 enters and engages an aligned radial notch (for example the aligned radial notch 44*a* as shown in FIG. 3), the lip 78 acting as a stop when contacting the annular plate outside circumference 80 for preventing further inward movement of the detent 70.

The detent 70 is inwardly biased into and for maintaining such notch engagement, such as by a diameter-aligned helical spring 84 (see FIG. 10) situated in mating oblong cavities 86, 88 in the detent inner portion 74 and the channel 68, with the spring's forward (i.e. inwardly directed) end 89 contacting the forward wall 90 of the detent cavity 86 and the spring rearward end 91 contacting the rearward wall 92 of the channel cavity 88. Upon outward urging of the detent member 70 with consequent compression of the spring 84, a stop 94 on the detent inner portion 74 forwardly of the spring 84 contacts stops 96 in the channel 68, preventing further outward movement of the detent member 70 when the detent forward end portion 82 is withdrawn from a radial notch 44, 46, 48 or 50. This condition is shown in the lower right quadrant of FIG. 3; when both detents 70 are withdrawn from an opposing pair of radial notches, rotation of the disk 38 is permitted with respect to the stationary annular plate 40. The channel cavity 88 inwardly of the stops 96 extends to permit passage of the detent stop 94 inwardly of the channel stops 96, the cavity extension being indicated by the reference numeral 98 (FIG. 7).

As shown in FIG. 3, the mount 36 is secured to the snowboard 10 such that the detent handles 72 are conveniently reachable by the snowboard user while not extending beyond the width of the snowboard 10. When in the condition shown in FIG. 3 (except that both detents 70 are in their positions engaging the first pair of notches 44*a*, 44*b*), the user secures one of the boot bindings 12 to the top surface of the boss 42 of the disk 38 such that his boot binding is oriented (with respect to the snowboard's longitudinal axis 23) in a personally preferred orientation for snowboarding, i.e. the binding is oriented in a preset snowboarding position when the detents are in engagement with the first pair of radial notches 44*a*, 44*b*. The user secures his other boot binding directly to the snowboard 10 in conventional manner, in a user-preferred snowboarding orientation with respect to the snowboard's longitudinal axis 23.

At the conclusion of a snowboarding run, the user may release his booted foot from the binding conventionally secured to the snowboard 10 (generally the rear foot), and the user may then manipulate the binding mount 36 of the present invention (normally securing the user's forward boot) by radially outwardly pulling the handles 72 of both detents 70, withdrawing the detent forward end portions 82 from the first pair of notches 44*a*, 44*b*. The user then pivots his foot (counterclockwise as viewed in FIG. 3 if the forward end of the snowboard extends downwardly as viewed in the drawing of FIG. 3), and he may release the detents 70 if he desires since the inwardly biased detents 70 cause the inner edge of each detent 70 to ride against the rotating circumferencial edge of the disk 38. When the second pair of opposing radial notches 46*a*, 46*b* is aligned with the detents 70, the detent forward end portions 82 snap into the respective notches 46*a*, 46*b* by the inward force of the spring 84, preventing further rotation of the disk 38. (The springs 84 are not shown in FIG. 3 for clarity of description.)

The second pair of notches 46*a*, 46*b* are spaced from the first pair of notches 44*a*, 44*b*, along the outer circumference 51 of the disk 38, such that the orientation of the secured boot binding is approximately parallel to the snowboard longitudinal axis 23 when the detents 70 engage the second pair of notches 46*a*, 46*b*. If the preset orientation of the boot binding 12 is 45°, and the angular spacing between the second pair of notches 46*a*, 46*b* and the first pair of notches 44*a*, 44*b* is 45°, the boot orientation would be parallel to the snowboard longitudinal axis 23 when the plate 38 is rotationally displaced such that the detents 70 engage the second pair of notches 46*a*, 46*b*. Another second pair of notches 48*a*, 48*b* is included in the preferred mount embodiment, angularly spaced 90° from the first pair of notches 44*a*, 44*b*, for permitting counterclockwise rotation of the disk 38 by 90° from its initial orientation; where the boot binding preset orientation is approximately 90° from the snowboard longitudinal axis 23, the user may continue rotation of the disk 38 until the detents 70 engage such other second pair of radial notches 48*a*, 48*b* whereupon the boot binding orientation would be parallel to the snowboard longitudinal axis 23. A further second pair of radially opposing notches 50*a*, 50*b* is preferably provided, evenly spaced between the other second pair of notches 48*a*, 48*b* and the first pair of notches 44*a*, 44*b*, for providing uniform angular spacing between all notches so that, when installing the mount 36 of the present invention onto a snowboard 10, care need not be taken in matching specific pairs of notches for mating with the detents 70. The preferred embodiment of the present invention includes notches that are 45° spaced from one another, although other spacings are of course possible.

As used herein, the term "approximately parallel to the snowboard longitudinal axis" is meant to include boot binding orientations which are substantially more closely parallel to the snowboard longitudinal axis 23 than the initial or preset snowboarding orientation when the detents 70 were engaged with the first pair of notches 44*a*, 44*b*, such that the orientation of the boot binding produced by rotational displacement by the present invention substantially facilitates walking with the user's boot secured thereto between snowboarding runs. For example, if the preset boot binding orientation were 60° from the snowboard longitudinal axis, a 45° counterclockwise displacement (i.e. with the detents 70 engaging the notches 46*a*, 46*b*) would result in a boot binding orientation for accommodating walking 15° from parallel to the longitudinal axis and is considered herein to be approximately parallel to the snowboard longitudinal axis. Similarly, if the preset boot binding orientation were 80° from the snowboard longitudinal axis, counterclockwise displacement wherein the detents 70 engage the next succeeding second pair of notches 48*a*, 48*b*, would result in a boot binding orientation of −10° (i.e. 10° on the other side of the longitudinal axis 23), herein considered to be approximately parallel to the snowboard longitudinal axis. A 67.5° preset orientation would result in a binding orientation for walking of 22.5° on either side of the snowboard longitudinal axis 23, depending upon whether the disk 38 is rotated 45° for engaging the dents 70 with the notch pair 46*a*, 46*b* or 90° for engaging the detents 70 with the notch pair 48*a*, 48*b*.

In preparation for a snowboarding run, the user again manipulates the binding mount 36 by radially outwardly pulling the handles 72 of both detents 70, withdrawing the detent forward end portions 82 from the selected second pair of notches. The user then pivots his foot (clockwise as viewed in FIG. 3) until the first pair of notches 44*a*, 44*b* is aligned with the detents 70. The detent forward end portions 82 snap into the respective notches 44*a*, 44*b* by the inward force of the spring 84, preventing further rotation of the disk 38 and locking the disk 38 in place. In such manner, the boot binding 12 is conveniently and accurately returned to the user-preferred snowboarding orientation which had been previously preset when the boot binding 12 had been secured to the disk 38.

Figure 11:
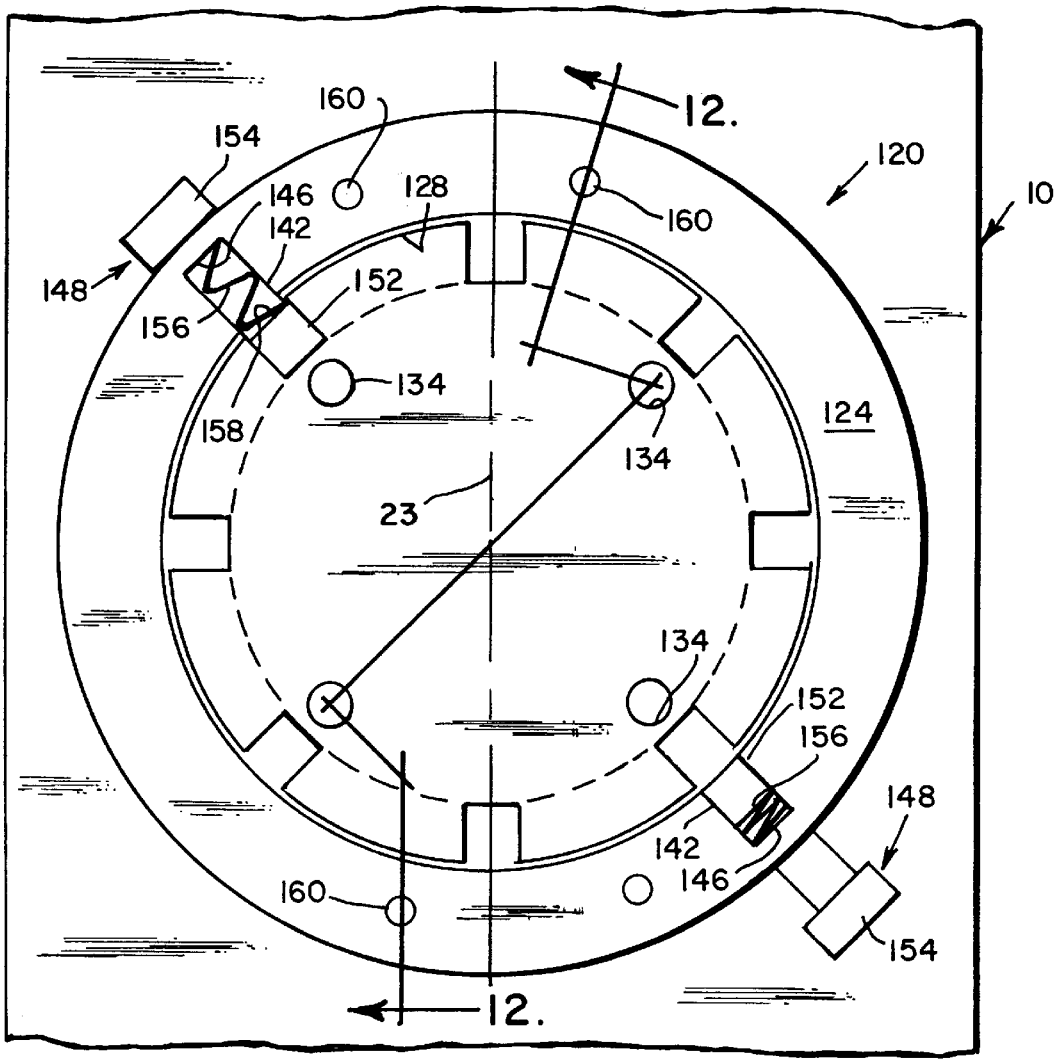
FIG. 11 is a plan view of an alternative embodiment of the binding mount of the present invention, shown secured to a fragment of a snowboard.
Figure 12:
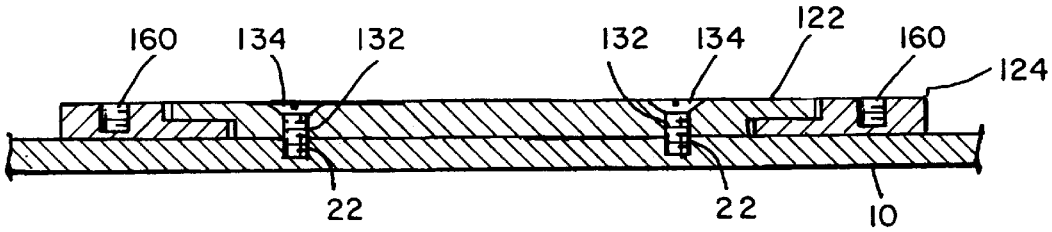
FIG. 12 is a sectional view of the apparatus of FIG. 11, taken along the line 12—12 in the direction of the appended arrows.

An alternative embodiment 120 of the boot binding mount device of the present invention is shown in FIGS. 11 through 18. The device 120 includes a first component or member 122 fixedly secured to the snowboard 10 and a cooperating second component or member 124 to which a boot binding 12 is to be secured, the second member 124 actuable for being rotated or pivoted with respect to the first member 122. As shown in FIGS. 11–14, the first member 122 comprises a circular plate or disk 122 of diameter D1 having a downwardly extending concentric boss 126 of diameter D2. Diameter D1 is greater than diameter D2, and the portion of the disk 122 between the circumference of the boss 126 and the circumference of the disk 122 is segmented into a plurality of segments 128 by a plurality of equally spaced radial notches 130, the spacing between notches preferably arranged such that each notch 130 is positioned with an opposite notch being 180° apart, i.e. opposite notch pairs are situated along a diameter of the disk 122 (FIGS. 11 and 13). The disk 122 includes bores 132 extending therethrough, such as the four bores 132 which are preferably arranged in a pattern for being aligned with four of the tapped blind apertures 22 of the snowboard 10 (FIG. 1), and the disk 122 is fixedly secured to the snowboard 10 by screws 134 extending through the bores 132 and threadably engaging the apertures 22 (FIG. 12).

The second member 124, in the alternative mount embodiment 120, comprises a flat ring or annular plate 124 (see in particular FIGS. 15–17) of outside diameter D3 and inside diameter D4, with an annular stepped recess or land 138 of diameter D5 inwardly of the annular plate's inner circumference 136. The recess outside diameter D5 is slightly greater than the outside diameter D1 of the disk 122, and the inside diameter D4 of the annular plate 124 is slightly greater than the disk boss diameter D2. The overall thicknesses (or height) of the disk 122 and annular plate 124 are preferably substantially the same, and the height H1 of the disk boss 126 (FIG. 14) is preferably slightly greater than the height H2 of the annular lip 140 supporting the land or recess 138 of the annular plate 24 (FIG. 17). Accordingly, the disk 122 may be inserted in the annular plate 124, with the underside of the annular plate segments 128 contacting the annular land or recess 138 of the annular plate 124. When the disk 122 and the annular plate 124 are so combined, and the disk 122 is fixedly secured to the snowboard 10 as shown in FIG. 11, the annular plate's land or recess 138 is vertically and horizontally captured by the disk's segments 128, and the annular plate 124 is rotatable with respect to the stationary disk 122 (FIG. 12).

As shown in FIGS. 11, 15 and 16, the annular plate 124 includes a pair of opposed channels 142 therein, aligned along one diameter of the annular plate 124, each channel 142 extending from the annular plate's outer circumference 137 to the annular plate's inner circumference 136. Each channel 142 extends beneath a bridge 144 inwardly of the annular plate's outer circumference 137, the bridge 144 having an inner wall 146. The channels 142 receive respective spring-loaded locking pins or detents 148 as explained below with reference to FIGS. 11 and 18.

Each detent member 148 includes an elongate section 150 of length substantially equal to the depth of the annular plate 124 (i.e., the difference between diameters D3 and D4), with an inner upwardly extending terminus 152 for being received by any one of the notches 130 of the disk 122. The outer end of the detent 130 includes an upwardly extending handle 154 for permitting the snowboard user to radially manipulate the detents 148 when the detents 148 are secured in their respective channels 142 and the disk/annular plate combination is secured to the snowboard 10. Each of the detents 148 is equipped with a compression spring 156 (FIG. 11), such as a stainless steel helical spring, supported along the detent member 148 and biased against the outwardly facing wall 158 of the detent's inner terminus 152 and the inwardly facing annular plate bridge wall 146, for inwardly biasing the detents 148 in their normal condition such that the inner termini 152 of the detents 148 are respectively received by opposite notches 130 for preventing rotation of the annular plate 124 about the stationary disk 122, as shown by the condition of the left detent 148 (as viewed in the drawing of FIG. 11) in its respective channel 142. When it is desired to rotate the annular plate 124 with respect to the stationary disk 122, the user radially outwardly pulls the handles 154 of both detents 148, withdrawing the detents' inner termini 152 from the respective disk notches 130 while further compressing the springs 156 (as shown by the condition of the right detent 148, as viewed in the drawing of FIG. 11). After the user rotates the annular plate 124 through a desired arc of rotation with opposite notches 130 positioned for receiving the respective detents 148, the user releases the handles 154 and the springs 156 cause the detents 148 to inwardly traverse their respective channels 142 such that the termini 152 of the respective detents 148 are received by the aligned notches 130, thereby preventing rotation of the annular plate 124 with respect to the stationary disk 122.

The alternative mount embodiment 120 is used in the same manner as is the preferred mount embodiment 36, except that the disk 122 of the alternative embodiment 120 is fixedly secured to the snowboard 10 and is stationary with respect thereto, and the boot binding 12 is secured to the annular plate 124 which is rotatable with respect to the stationary disk 122.

In either embodiment, the disk, annular plate and detents may be manufactured of a material of suitable rigidity and strength, preferably of aluminum although other materials such as stainless steel, or plastics, may be used.

Thus, there has been described a preferred embodiment of a device for mounting a boot binding to a snowboard, permitting the binding to be easily rotated between a user-preferred snowboarding orientation preset by the binding, to an orientation approximately parallel to the snowboard's longitudinal axis, and to be conveniently and accurately returned to the user-preferred preset snowboarding orientation. Other embodiments of the invention, as well as variations in the embodiments presented, may be developed without departing from the essential characteristics thereof. Accordingly, the invention should be limited only by the scope of the claims listed below.

I claim:

1. A mount for a binding for a snowboard, the mount comprising the combination of:

a first member adapted to be fixedly secured to the binding;

a second member adapted to be fixedly secured to the snowboard, said second member capturing said first member with said first member rotationally displaceable with respect to said second member when said second member is secured to the snowboard;

a first pair of opposing radial notches along the periphery of one of said members, and a second pair of opposing radial notches along the periphery of said one of said members;

a pair of opposing radially inwardly biased detents carried by the other of said members for engaging either of said first and second pairs of notches to prevent rotation of said first member, said detents being outwardly urgeable for disengaging from said first and second pairs of notches to permit rotation of said first member;

said detents respectively engaging said first pair of notches when said first member is secured to the binding oriented in a preset snowboarding position; and said second pair of notches being spaced from said first pair of notches such that the binding orientation is approximately parallel to the snowboard longitudinal axis when said first member is rotationally displaced with said pair of detents engaging said second pair of notches.

2. The mount according to claim 1, wherein:

said first member is a disk with said first and second pairs of notches along the circumference of said disk, said disk including a circular boss concentric with said circumference;

said second member is an annular plate having a central bore receiving said boss and further having an annular recess extending from said bore and receiving the remainder of said disk; and said detents are carried by said annular plate.

3. The mount according to claim 1, wherein:

said second member is a disk with said first and second pairs of notches along the circumference of said disk, said disk including a circular boss concentric with said circumference;

said first member is an annular plate having a central bore receiving said boss and further having an annular recess extending from said bore and receiving the remainder of said disk; and said detents are carried by said annular plate.

4. A mount for a binding for a snowboard, the mount comprising the combination of:

a first member adapted to be fixedly secured to the binding;

a second member adapted to be fixedly secured to the snowboard, said second member capturing said first member with said first member rotationally displaceable with respect to said second member when said second member is secured to the snowboard;

a first pair of opposing radial notches along the periphery of one of said members, and a plurality of second pairs of opposing radial notches along the periphery of said one of said members;

a pair of opposing radially inwardly biased detents carried by the other of said members for engaging either of said first pair of notches or a one of said second pairs of notches to prevent rotation of said first member, said detents being outwardly urgeable for disengaging from said first and second pairs of notches to permit rotation of said first member;

said detents respectively engaging said first pair of notches when said first member is secured to the binding oriented in a preset snowboarding position; and said second pair of notches being spaced from said first pair of notches such that the binding orientation is approximately parallel to the snowboard longitudinal axis when said first member is rotationally displaced with said pair of detents engaging a selected one of said second pair of notches.

5. The mount according to claim 4, wherein:

said first member is a disk with said first and second pairs of notches along the circumference of said disk, said disk including a circular boss concentric with said circumference;

said second member is an annular plate having a central bore receiving said boss and further having an annular recess extending from said bore and receiving the remainder of said disk; and said detents are carried by said annular plate.

6. The mount according to claim 5, wherein:

said notches are equally spaced along said circumference.

7. The mount according to claim 5, wherein:

said notches are successively spaced 45° apart along said circumference.

8. The mount according to claim 4, wherein:

said second member is a disk with said first and second pairs of notches along the circumference of said disk, said disk including a circular boss concentric with said circumference;

said first member is an annular plate having a central bore receiving said boss and further having an annular recess extending from said bore and receiving the remainder of said disk; and said detents are carried by said annular plate.

9. The mount according to claim 8, wherein:

said notches are equally spaced along said circumference.

10. The mount according to claim 8, wherein:

said notches are successively spaced 45° apart along said circumference.

11. A mount for a binding for a snowboard, the mount comprising the combination of:

a first member adapted to be fixedly secured to the binding;

a second member adapted to be fixedly secured to the snowboard, said second member capturing said first member with said first member rotationally displaceable with respect to said second member when said second member is secured to the snowboard;

a first radial notch along the periphery of one of said members, and a second radial notch along the periphery of said one of said members;

a radially inwardly biased detent carried by the other of said members for engaging either of said first and second notches to prevent rotation of said first member, said detent being outwardly urgeable for disengaging from said first and second notches to permit rotation of said first member;

said detent engaging said first notch when said first member is secured to the binding oriented in a preset snowboarding position; and said second notch being spaced from said first notch such that the binding orientation is approximately parallel to the snowboard longitudinal axis when said first member is rotationally displaced with said detent engaging said second notch.

12. The mount according to claim 11, wherein:

said first member is a disk with said first and second notches along the circumference of said disk, said disk including a circular boss concentric with said circumference;

said second member is an annular plate having a central bore receiving said boss and further having an annular recess extending from said bore and receiving the remainder of said disk; and said detent is carried by said annular plate.

13. The mount according to claim 11, wherein:

said second member is a disk with said first and second notches along the circumference of said disk, said disk including a circular boss concentric with said circumference;

said first member is an annular plate having a central bore receiving said boss and further having an annular recess extending from said bore and receiving the remainder of said disk; and said detent is carried by said annular plate.

14. A mount for a binding for a snowboard, the mount comprising the combination of:

a first member adapted to be fixedly secured to the binding;

a second member adapted to be fixedly secured to the snowboard, said second member capturing said first member with said first member rotationally displaceable with respect to said second member when said second member is secured to the snowboard;

a first radial notch along the periphery of one of said members, and a plurality of second radial notches along the periphery of said one of said members;

a radially inwardly biased detent carried by the other of said members for engaging either of said first notch or a one of said second notches to prevent rotation of said first member, said detent being outwardly urgeable for disengaging from said first and second notches to permit rotation of said first member;

said detent engaging said first notch when said first member is secured to the binding oriented in a preset snowboarding position; and said second notches being spaced from said first notch such that the binding orientation is approximately parallel to the snowboard longitudinal axis when said first member is rotationally displaced with said detent engaging a selected one of said second notches.

15. The mount according to claim 14, wherein:

said first member is a disk with said first and second notches along the circumference of said disk, said disk including a circular boss concentric with said circumference;

said second member is an annular plate having a central bore receiving said boss and further having an annular recess extending from said bore and receiving the remainder of said disk; and said detent is carried by said annular plate.

16. The mount according to claim 15, wherein:

said notches are equally spaced along said circumference.

17. The mount according to claim 15, wherein:

said notches are successively spaced 45° apart along said circumference.

18. The mount according to claim 14, wherein:

said second member is a disk with said first and second notches along the circumference of said disk, said disk including a circular boss concentric with said circumference;

said first member is an annular plate having a central bore receiving said boss and further having an annular recess extending from said bore and receiving the remainder of said disk; and said detent is carried by said annular plate.

19. The mount according to claim 18, wherein:

said notches are equally spaced along said circumference.

20. The mount according to claim 18, wherein:

said notches are successively spaced 45° apart along said circumference.

* * * * *